United States Patent [19]

Logan

[11] Patent Number: 4,858,689

[45] Date of Patent: Aug. 22, 1989

[54] COAL GASIFICATION WELL DRILLING PROCESS

[75] Inventor: Terry L. Logan, Grand Junction, Colo.

[73] Assignee: Resource Enterprises, Inc., Salt Lake City, Utah

[21] Appl. No.: 179,663

[22] Filed: Apr. 11, 1988

[51] Int. Cl.[4] ..... E21B 43/243

[52] U.S. Cl. ..... 166/256; 299/4

[58] Field of Search ..... 166/256, 50, 245; 299/4

[56] References Cited

U.S. PATENT DOCUMENTS

| | | | |
|---|---|---|---|
| 4,249,775 | 2/1981 | Zakiewicz | 299/4 |
| 4,422,505 | 12/1983 | Collins | 166/256 |
| 4,573,531 | 3/1986 | Garkusha et al. | 166/256 X |

OTHER PUBLICATIONS

Rollins Module No. 2, Nov. 1981, DOE.

*Primary Examiner*—William P. Neuder
*Attorney, Agent, or Firm*—M. Reid Russell

[57] ABSTRACT

An in-situ coal gasification process for practice on a formation having one or more dipping coal seams that involves, directionally drilling a production wellbore into a burn module designated in each coal seam each from a separate surface location and, from one surface location, directionally drilling injection wellbores to a designated burn module in a coal seam. In practicing the process, a drilling platform is positioned to be proximate to a vertical line from a head or top end of each coal seam burn module for drilling, as nearly to the vertical as possible, a production wellbore into each coal seam entering the coal seam burn module above the head end, which drilling is then curved into that burn module to proceed longitudinally therein from end to end with pairs of injection wellbores drilled from a single surface location vertically through the coal seam that are then curved back into the burn module at a certain vertical depth, to be at angles to, and spaced a desired distance from the side of each production wellbore. Which injection wellbores are at angle to each production wellbore and are open, or are opened by perforating or slotting, to receive a burn material or enhancer therein. The gaseous products of each coal seam burn module burning to be drawn to the surface through each production wellbore.

12 Claims, 3 Drawing Sheets

COAL GASIFICATION WELL DRILLING PROCESS

BACKGROUND OF THE INVENTION

1. Field of the Invention

This invention relates to processes and methods for forming injection and production wellbores into a subterranean mineral deposit for providing in-situ recovery from that formation.

2. Prior Art

Today, with an increasing scarcity of surface accessible mineral formations, more and more attention is being paid to in-situ mineral recovery techniques and processes. As for example, in the area of oil shale formation refining, there has been increasing interest in practicing in-situ recovery techniques involving the forming of spaced-apart wellbores into a formation. A material for burning, steam under pressure, or the like, is then introduced into the formation through an injection system of wellbores. The material separates certain of the hydrocarbon components of that formation that are then withdrawn through one or more production wellbores. Heretofore, such in-situ refining has involved mining into or exposing the formation and then forming, with appropriate spacing from one another, injection wellbores into the formation along with one or more production wellbores to extend an appropriate distance therein. This in-situ process has been favored where the formation is exposed or nearly exposed to the surface, minimizing the difficulties in mining into the formation to form the production and injection wellbores. Further, similar in-situ methods have been employed in minerals recovery wherein production and injection shafts or wellbores have been placed into a subterranean formation. Whereafter, acid or steam under pressure is introduced through the injection shaft or wellbore to produce a chemical reaction. The minerals separated by that reaction are then removed through the production shaft.

Heretofore, in-situ mineral recovery systems have generally been practiced on fairly accessible formations. Particularly, for an in-situ process to be commercially practical for hydrocarbon recovery from coalbeds, oil shale or oil sands, only seams or formations close to the surface have justified the costs of tunneling and/or boring when compared with the value of the final product produced from such refining.

Where production systems involving drilling rather than tunneling have heretofore been practiced for recovering hydrocarbons from an underground formation, such have generally been limited to oil and/or natural gas production. The present invention, unlike such other earlier systems, is directed towards a process for commercially recovering gases from burning of a coal seam or bed that tilts or dips from the horizontal away from the surface. Only recently have drilling equipment and procedures been developed that allow for exactly drilling each wellbore to a desired location in a formation so as to obtain a flow of products of combustion thereacross.

In the past, where attempts have been made to recover gases by burning a formation such, unlike the present invention, have involved slant drilling techniques where a drilling rig is located and relocated each time a production or injection wellbore is drilled so as to provide spacing therebetween. In consideration of the drilling distance required in a slant drilling operation where the hole is drilled a distance that is the square root of the squares of the horizontal and vertical distance to a point in the formation, directional drilling becomes impractical at a relatively small distance from the surface for a coal seam that dips away from the drilling platform.

An attempt was made that utilized slant drilling techniques to install separate production and injection wells into a dipping coal seam. This attempt was made by Gulf Research and Development Company under a U.S. Department of Energy (DOE) Contract No. DE-AC03-77ET13108, and was known as Rawlins Module No. 2. This project involved drilling a number of wellbores from spaced-apart surface locations into a burn module that was located near ground surface. Each production wellbore in this project was drilled at a slant angle from the horizontal to a point location in that coal seam module, whereafter the drill string was then bent to drill within that seam. This process required that each drilling operation progress from a separate surface location at a slant angle to intersect the coal seam. Each wellbore thereby involved a substantial drilling distance. Of course, the drilling distance to the coal seam will increase dramatically as the seam depth and distance from the drilling site increases. Accordingly, utilizing such slant drilling techniques to form a number of production and injection wellbores quickly becomes uneconomical at coal seam module depths beyond a few hundred feet from the surface, rendering such procedure impractical.

The present invention provides a process for recovering gas from the combustion of burn module of a coal seam that is located at a depth well below the ground surface. The present invention provides for directionally drilling injection and production wellbores so as to minimize the drilling distance from the surface to points within the burn module and further provides for performing this drilling from essentially a single surface location and utilizing a single drilling platform. The present invention provides a drilling process that can be practiced at minimum cost so as to render practical the in-situ recovery of even deep portions of a dipping coal seam.

SUMMARY OF THE INVENTION

It is a principal object of the present invention to provide a process for forming separate individual injection and production wellbores into and within a section of a dipping coal seam, the injection wellbore or bores to receive a burning agent therein. The production wellbore to draw to the surface gases from that coal seam combustion.

Another object of the present invention is to provide a process that utilizes directional drilling techniques for forming spaced-apart production and injection wellbores into a burn module section of a dipping coal seam from a single drilling location.

Another object of the present invention is to provide a process for drilling a production wellbore to enter and extend longitudinally within a dipping coal seam, the wellbore to vertically pass into the seam and is then curved so as to remain within the seam and extend the length of a section thereof that is designated as a burn module.

Still another object of the present invention is to provide a process for drilling one or more injection wellbores from a single location to intersect a section of a dipping coal seam designated as the burn module, each wellbore is drilled to pass through the coal seam and curve back into it at a right angle, the injection wellbores to be spaced a desired distance from the production wellbore and from each other.

Still another object of the present invention is to verify when a desired wellbore spacing is achieved by sensing a certain pressure differential between an injection wellbore as it is being drilled and the production wellbore.

Still another object of he present invention is to provide for in-situ processing of a plurality of dipping coal seams layered within a single formation utilizing directional drilling techniques where production wellbores are formed within and along a burn module of each coal seam from separate surface locations, and forming injection wellbores into the coal seams from one of the surface locations.

Still another object of the present invention is to provide a process for directionally drilling a plurality of injection and production wellbores into one or more burn modules of one or more dipping coal seams, the drilling to proceed from a single surface location for each production wellbore, each wellbore formed to be as nearly vertical as possible to the dipping coal seam and is curved or bent appropriately to intersect a section or sections therein designated as burn modules, thereby minimizing the drilling distance and resultant drilling costs.

In accordance with the above objects, a first embodiment of the present invention is in a process for directionally drilling, from a single surface location, an array of injection and production wellbores into a section of a dipping coal seam designated as a burn module. The process preferably involves forming a plurality of injection wellbores to pass a burn material therethrough that is ignited in the burn module. The gaseous products of that burning are then removed through the production wellbore. The single drilling platform that is preferably used in a practice of the process on a single dipping coal seam is located so as to involve a minimum vertical drilling distance to the designated burn module portion of the coal seam to be processed, and taking into account the surface terrain. In the drilling process the wellbores are passed through the coal seam roof. Or with the platform located alongside of the coal seam, the drilling path extends vertically alongside the seam, to enter the seam through its floor. From the single surface location for the single dipping coal seam the injection and production wellbores are formed by directional drilling methods to and into the burn module of the coal seam. The drilling is directed so to provide appropriate spacing between the injection and production wellbores within the burn module, whereby the gaseous products of burning will pass therebetween to be withdrawn through the production wellbore.

The process is preferably practiced on a coal seam with a surface outcropping that dips twenty (20) degrees or more below the horizontal. A coal seam burn module for practicing the present process is identified based on the physical characteristics of that coal seam, as well as its dip angle and the distance of that module from the surface. For a single coal seam formation, the coal seam is divided into burn modules with appropriate spacing therebetween. A practice of the in-situ process of the present invention for such single coal seam burn module includes drilling a production wellbore that will enter the coal seam at its upper end and is curved to proceed longitudinally therealong, just above the coal seam floor, to the other end of the burn module.

After formation, the production wellbore is cased from the ground surface to where it enters the coal seam burn module upper end. Preferably, one or more pairs of injection wells are placed from the same surface location to pass through the coal seam and are then curved back towards that coal seam to intersect the burn module at an angle to the side of the production wellbore. So arranged, with the injection wellbores cased to where they enter the burn module and by igniting and burning the coal seam at the open ends thereof, the products of the burn module combustion can be withdrawn through the production wellbore.

In practice, multiple coal seams are sometimes found layered in a dipping formation. For in-situ processing of such multiple coal seams, the present process preferably provides for forming each production wellbore to be as nearly vertical as possible from a surface location to curve into and continue from end to end within a section of that seam designated as a burn module. Accordingly, drilling as nearly vertical as possible in forming production wellbores to the separated coal seams requires relocating the drilling site for each such coal seam. For forming the injection wellbore or wellbores, however, a single surface location is utilized wherefrom one of the production wellbores is drilled. The injection wellbores are formed through the lower of the coal seams and are curved back into the formation to the most upper coal seam or the coal seam closest to the surface. The production wellbores are cased, as described above, with respect to the single dipping coal seam processing, and the injection wellbores are cased from the surface to the ends thereof in the upper coal seam. The upper coal seam is then burned, with the gaseous products of that combustion drawn through the production wellbore formed in that upper coal seam. Thereafter, the injection wellbores are plugged to the next lowest coal seam and the casings perforated adjacent to the production wellbore formed in that coal seam. A burn material is introduced through the injection wellbore perforations to burn that lower coal seam, with the gaseous products produced in that burning withdrawn through the production wellbore formed in that lower coal seam.

In the drilling process, for locating or determining when the injection wellbore ends are properly spaced from the production wellbore, the present invention provides for sensing a certain pressure differential therebetween that is preferably measured at that production wellbore. Sensing of that certain pressure differential indicates proper spacing as one of a number of indicators, such as drill string length, sonar locating instrumentation and other instrumentation as is utilized in the directional drilling processes thereby providing for proper injection wellbore locating relative to the production wellbore or bores.

DESCRIPTION OF THE DRAWINGS

These and other objects and features will be apparent from the following detailed description in which preferred methods for practicing the process of the present invention have been described in detail in conjunction with the accompanying drawings.

DETAILED DESCRIPTION

New Developments

Figure 1:
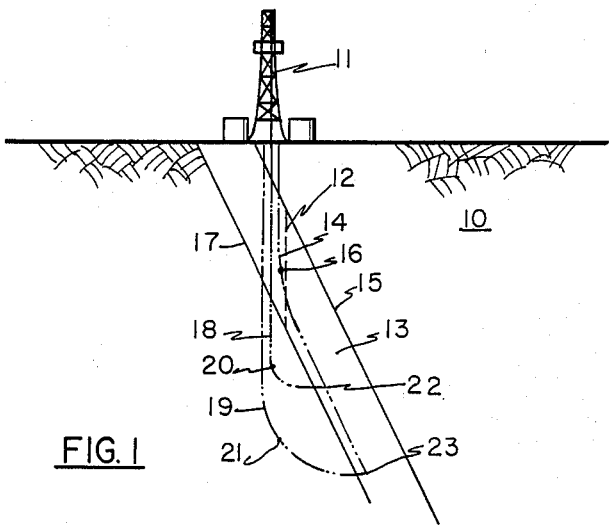
FIG. 1 is a side elevation schematic view of one embodiment of the process of the present invention for forming injection and production wellbores into a single dipping coal seam.

Until very recently, directional drilling techniques and equipment for directionally drilling a wellbore to a point or location under the surface have been less than reliable and were not cost effective. For formations or deposits, such as a steeply dipping coal seam, a driller could not reliably drill a wellbore into a formation so as to intersect a point or another wellbore therein. Recently, directional drilling reliability has been greatly improved with the development of a directional drilling tool known as a mud motor. Such tool employs drilling fluid or mud that is pumped under pressure from the surface to turn a cutting bit end thereof. With this arrangement, the drilling operation is independent of a drill string turned from the surface. This mud motor turning a bit can be steered by "pushing off" the assembly and drill string from the wellbore wall. Using a mud motor, an operator can reliably drill a curved wellbore from a kick-off point so as to redirect the drill bit. At such kick-off point, the drill pipe is supported through the turn by spaced wear knots. The components of the assembly for both cutting the wellbore and steering the assembly are arranged at the bottomhole end of the drill string and are supplied fluid under pressure through that drill string from the ground surface. In practice, with the inclusion of an instrument package that is connected in tandem behind the mud motor, and by monitoring the cuttings from the drilling, the cutting bit can be triaxially located and steered during the drilling process. Also, the drill bit positioning is periodically checked by introducing survey instruments into the well when the drill string is removed. A drill operator thereby has a capability for drilling curved holes to a determined sub-surface point and can change the direction of the curve so as to drill a wellbore into and within a designated burn module of a coal seam.

An evaluation of the potential for processing steeply dipping coalbeds involved a project proposed by Gulf Research and Development Company, concerning a coal field near Rawlins, Wyo. This approach, however, involved practicing slant drilling techniques from spaced-apart surface locations to drill into such dipping coal seam. The project did, however, involve curving the drilling from a slanted hole to within a coal seam module, the drill bit traveling the length thereof, as a production wellbore. With other straight slant holes formed to intersect the seam as injection wellbores at vertically spaced apart locations. Obviously, as the coal seam dips steeper, the slant drilling distance increases as governed by the slant angle and coal seam depth. Accordingly, drilling costs increase markedly as the coal seam dips steeper making it economically practical to only in-situ process sections of such dipping coal seam as are near the surface. Further, with the expense involved in breaking down and resetting up the drilling platform at each surface location for individually forming each injection and production wellbore, or employing a number of drill rigs, slant drilling techniques are of questionable practicality for even processing shallow coal seam modules. The project did, however, prove that in-situ coal gasification was possible.

The Invention

The process of the present invention adopts current drilling technology to locate injection and production wellbores into sections of even a steeply dipping coal seam or seams. The wellbores are then used for gasifying by burning the coal therein to release gases, which gases are then captured and commercially refined at the surface. The present invention departs from earlier technology in that it recognizes that, for a commercially successful coal gasification of a steeply dipping coal seam, the drilling distance to the seam burn module should be as close to vertical as practical and that for in-situ refining of a single coal seam the separate wellbores should be drilled from a single surface location using a single platform. To this end, the present invention has developed embodiments of drilling processes for in-situ recovery of gases as a product of burning of modules of single and multiple steeply dipping coal seams.

FIG. 1 shows a first embodiment of a preferred process of the present invention for forming injection and production wellbores into a burn module of a single dipping coal seam. Therein is depicted at 10 a side elevation schematic view of a drilling tower 11, that should be considered to be conventional. From this drilling tower, as will be described in detail hereinbelow with respect to a discussion of FIG. 2 and in FIG. 5, a number of wellbores are formed to extend to a burn module 13 of the single steeply dipping coal seam 12. A first wellbore 14, that is illustrated also in FIG. 5, is shown extending through the coal seam roof or ceiling 15, and is then bent or angled from a kick-off point 16. The wellbore 14 is shown to extend longitudinally the length of the burn module and is spaced above the seam bottom or floor 17. Also shown emanating from the single drilling location, are injection wellbores 18 and 19, these wellbores each passing through both the seam roof or ceiling 15 and bottom or floor 17. Beyond the seam, the injection wellbores are curved or bent from kick-off points 20 and 21, respectively, turning back to the seam burn module 13, entering that burn module at angles to the production wellbore 14. Ends 22 and 23, respectively, of injection wellbores 18 and 19 are spaced a certain distance from the production wellbore 14 taking into account the coal seam physical characteristics, as will be set out in more detail immediately hereinbelow with respect to a further discussion of FIGS. 3, 4, and 5.

During their formation, the injection wellbore ends 22 and 23 are drilled to an optimal location within the burn module 13 utilizing sensing and survey instruments whereby the wellbore ends are spaced appropriately apart at an angle to the side of the production wellbore 14. The desired injection wellbore end spacing is dependent upon the coal seam characteristics. So arranged, a gaseous flow produced in a burning of the coal seam that is started at each of the injection wellbore ends and travels into that seam will flow to the production wellbore. The measuring and sensing of actual spacing distance between an injection wellbore end and the production wellbore during the injection wellbore formation process will be described in detail later herein.

Figure 2:
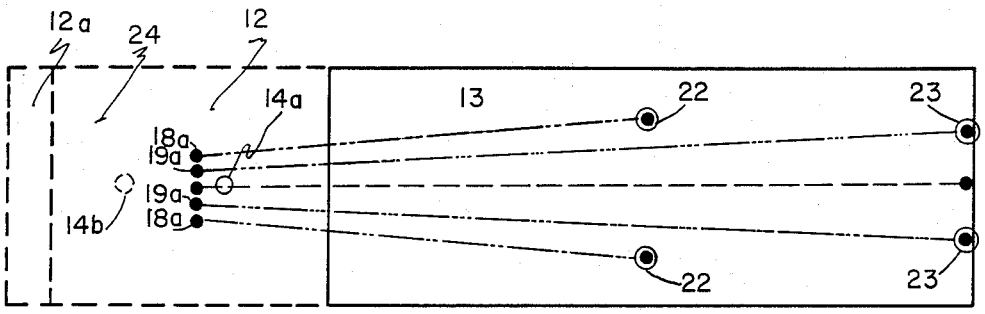
FIG. 2 is a top plan view of a surface drill site showing, an array of injection wellbore heads and, in broken lines, shows alternative production wellbore head locations.

In FIG. 2 is shown the ground surface 24 whereon the drill rig 11 is positioned so as to be alongside an outcropping 12*a* of the coal seam 12. At this surface location, the pairs of aligned injection wellbore head ends 18*a* and 19*a* are shown. Shown in broken lines at 14*a* and 14*b* are alternative positions of the production wellbore head end, which head end is either forward or back from the one of the injection wellbore head ends 18*a* and 19*a*. While, of course, two pairs of injection wellbores are illustrated in this embodiment, it should be understood that the present invention could be practiced utilizing one injection wellbore and one production wellbore only or could involve more or less than the two pairs of injection wellbores shown within the scope of this disclosure. Coal seam ends 22 of the pair of injection wellbores 18 intersect the burn module 13 at approximately its center, with the pair of injection wellbores 19 coal seam ends 23 intersecting the burn module 13 at approximately its lower end. The injection wellbore seam ends 22 and 23 are formed into the coal seam burn module to straddle equidistantly the production wellbore 14, and are spaced therefrom a distance to allow gaseous flow therebetween taking into account the coal seam physical characteristics.

In the drilling of the injection wellbores 18 and 19 it is preferred to have the head ends 17*a* and 18*a* thereof aligned, with the head end 14*a* or 14*b* of the production wellbore 14 spaced forward or back from a line between the injection wellbore head ends. This preferred off-setting is to avoid cross interference in the drilling between the injection and production wellbores, which wellbore integrity is further insured, as will be set out later herein, by individually casing each of the wellbores from the surface to the coal seam burn module 13. In practice, a spacing distance of the production wellbore head of approximately ten (10) feet, either forward of or back from the line of the injection wellbores will be satisfactory.

Figure 3:
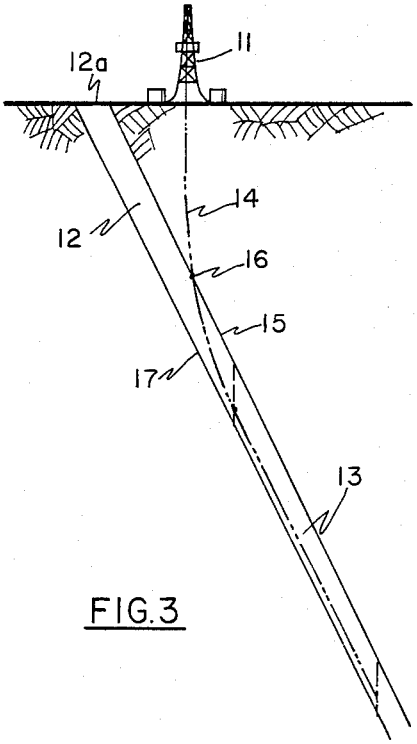
FIG. 3 is an enlarged view of the dipping coal seam module of FIG. 1 showing a production wellbore formed therein.
Figure 4:
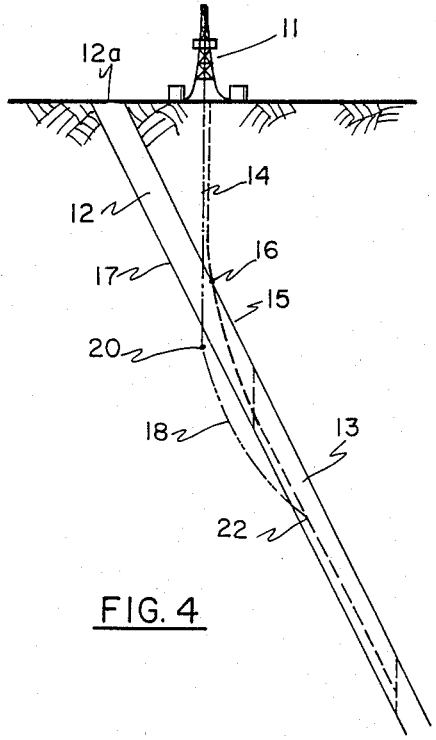
FIG. 4 is a figure like that of FIG. 3, and additionally shows a first pair of injection wellbores formed into the coal seam burn module.
Figure 5:
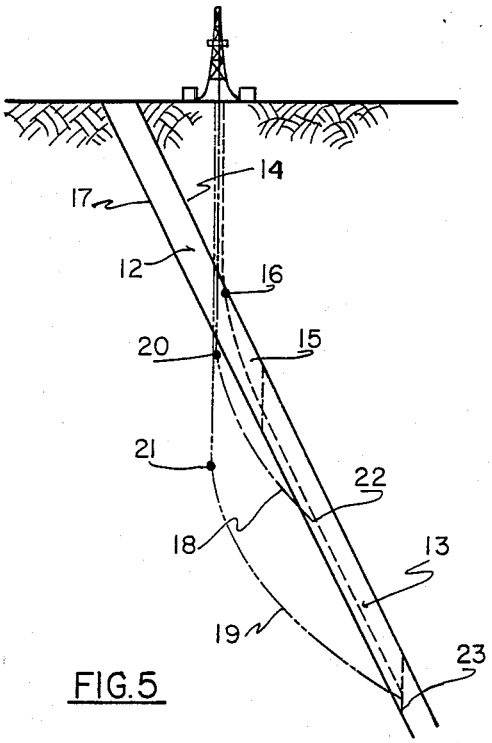
FIG. 5 is a figure like FIGS. 3 and 4, and additionally shows a second pair of injection wellbores formed into the coal seam burn module.

With reference to FIGS. 3 through 5, a preferred process is described as being practiced on a single dipping coal seam. In FIG. 2 the single coal seam is shown to have a surface outcropping 12*a*. In practice, a coal seam that dips at an angle from the horizontal of twenty (20) degrees to eighty (80) degrees is suitable for practicing the present process on. In the above discussion, a first burn module 13 is shown that is a designated section of the coal seam having dimensions that are appropriate for practicing the present process on. This designation takes into account the physical characteristics of that coal seam. Of course, additional deeper burn modules can be identified and processed utilizing the process of the present invention, as limited by the costs of processing successively deeper burn modules.

EXAMPLE

This example involves a commercial ammonia/urea facility for gasifying a coal formation that is commonly known as sub-bituminous in rank as is prevalent in the State of Wyoming. The process will gasify up to one hundred (100) tons of coal per day, producing sixty million (60,000,000) standard cubic feet of low Btu coal gas as the product of that burning. Ultimately, this production would produce four hundred fifty (450) tons of granulated urea and approximately ninety (90) tons of ammonia per day. This example is hypothetical and involves a formation having a single coal seam. The coal seam is assumed to have a dip angle of approximately sixty three (63) degrees from the horizontal and is approximately twenty three (23) feet thick. For this formation, a burn module is designated to be one hundred fifty (150) feet wide and four hundred seven (407) feet vertical in plan view which equates to eight hundred ninety eight (898) feet in length for the dip angle of sixty three (63) degrees. Preferably, there will be a separation of seventy five (75) feet between burn modules, and processing will be from the uppermost burn module down.

Figure 7:
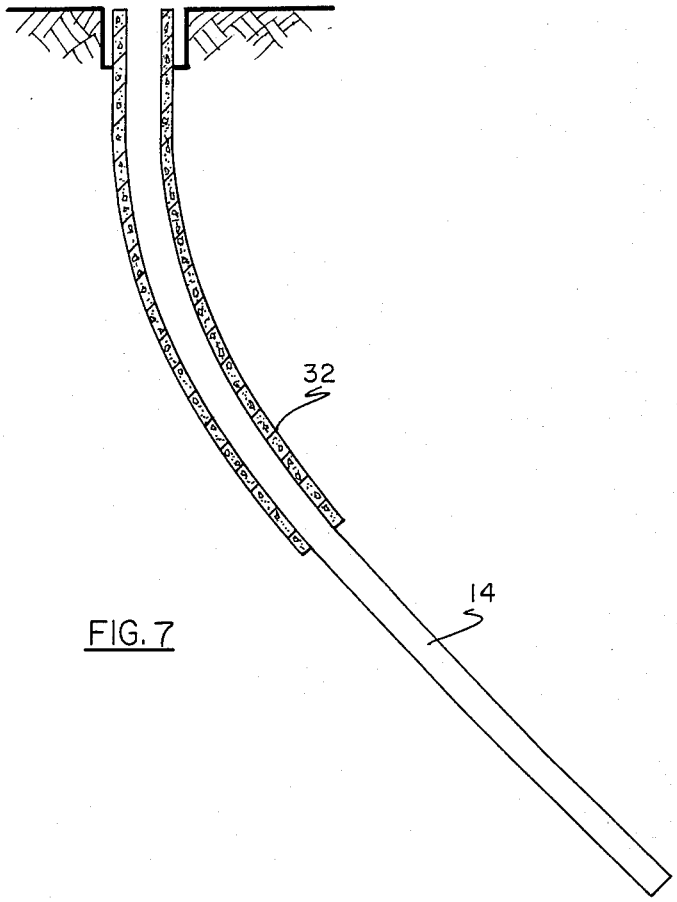
FIG. 7 shows the production wellbore illustrated in FIG. 3, that has been cased from the ground surface adjacent to the head end of the coal seam burn module.

Each burn module is to be in-situ processed utilizing five (5) process wellbores consisting of: four (4) injection wellbores and one (1) production wellbore. Each wellbore is individually drilled from the single drilling location 11 to seam 12, as discussed hereinabove with respect to FIGS. 1 through 5. The injection wellbores 18 and 19 intersect the production wellbore at approximately four hundred (400) feet true vertical depth (TVD) and twelve hundred (1200) feet true vertical depth, respectively, and, the production wellbore 14 is optimally spaced approximately five (5) feet above the base or floor 17 of the burn module 13. This arrangement is illustrated best in FIG. 5. Shown therein the production wellbore 14 is formed to be essentially vertical to where it passes through the seam roof 15, upstream from the burn module 13. It is bent or angled from a kick-off point 16 to enter the burn module upper end so as to be approximately five (5) feet above the module floor 17 and extends longitudinally therein the length of the module. After formation, as illustrated in FIG. 7, the production wellbore is preferably cased at 32, using standard casing methods, from the surface to where it enters the upper end of the burn module 13. The production wellbore is left open along its length within the burn module to receive the gaseous products produced in burning that burn module.

Figure 8:
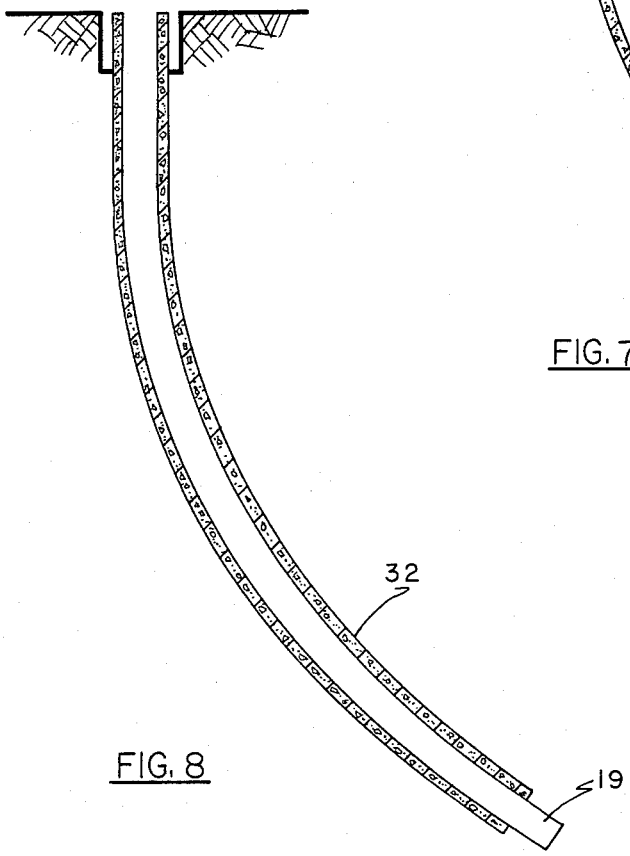
FIG. 8 shows one of the injection wellbores of FIGS. 4 or 5, that has been cased from the ground surface to where it enters the burn module.

The injection wellbores 18 and 19 are drilled essentially vertically from the surface, passing through an area of the coal seam 12 above the burn module 13 and are then angled or bent from kick-off points 20 and 21, respectively, so as to reenter the coal seam 12 burn module 13, through the bottom or floor 17 thereof. The pair of injection wellbores 18 enter the burn module at approximately eight hundred (800) feet true vertical depth (TVD), and the other pair of injection wellbores 19 enter the burn module 13 at approximately twelve hundred (1200) feet true vertical depth (TVD). After drilling, as illustrated in FIG. 8, each injection wellbore 18 and 19 is preferably cased at 32 from the surface, through the coal seam 12 to where it enters the burn module 13.

The above example illustrates a processing of a first burn module 13 from the surface of a dipping coal seam, identified as sub-bituminous in rank. Though, of course, the process can be practiced on coal seams having a variety of physical characteristics. While not shown, it should be understood that, utilizing the drilling process of the present invention for a coal seam of approximately the dimensions shown which is at a dip angle of from twenty (20) to eighty (80) degrees from the horizontal, a second or more modules can be economically processed. Each such module is spaced approximately seventy five (75) feet from the one immediately above to a true vertical depth (TVD) of approximately two thousand (2,000) feet. For such second and successive burn modules, the drilling location 11 will preferably be moved to where it is just off-set from the burn module upper end, similar to the arrangement shown in FIGS. 3 through 5, to provide an off-set from that burn module upper end. So arranged, from the single location, the production and injection wellbore are formed to and into such second and successive burn modules as set out above.

Figure 6:
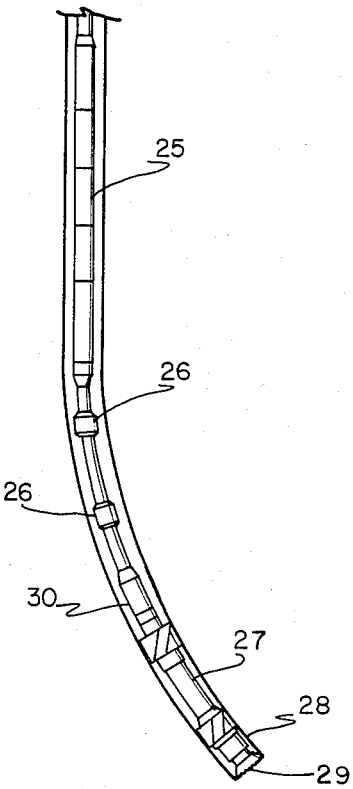
FIG. 6 shows a schematic of an angle building assembly for drilling a curved wellbore.

A practice of the above process for forming a system of production and injection wellbores involves directionally drilling from the vertical to the coal seam 12. As set out above, this drilling involves curving or angling the wellbore from a kick-off point, that is shown at, respectively, 16 for the production wellbore 14, and 20 and 21 for the injection wellbores 18 and 19, as shown in FIGS. 1 and 3 through 5. The kick-off point serves as a base from where the drilling is curved to the coal seam. The amount of drilling curve, of course, depends upon the actual distance from the vertical that the drill bit must travel to reach a desired entry point in the burn module 13. As shown in FIGS. 3 through 4, the respective injection and production wellbores each have different kick-off points. Each wellbore kicks-off from the vertical at a predetermined angle so as to reach a designated point or target in the burn module. FIG. 6 shows an example of an angle building assembly as would be appropriate for forming the production and injection wellbores 14, 18 and 19.

Shown in FIG. 6, on reaching the kick-off point, the drilling direction is changed by operation of a tool steering section 30 that is fitted to the end of a drill string 25. The drill string 25 includes compressive strength drill pipe with wear knots 26 spaced at intervals thereon. The wear knots 26 are provided to make contact with the wellbore wall. The drill string is to be supported through the wear knots around the wellbore bend, as shown in FIG. 6. The tool steering section 30, as shown in FIG. 6, connects in tandem to an angle building motor system 27 that also connects in tandem to the drill string. The angle building motor system is operated by drilling fluid or mud that is passed under pressure from the surface to turn bit 28 causing teeth 29 thereof to cut into that rock ahead of that bit. The fluid or mud for turning that motor system 27 is selected to both provide for turning the angle building motor system and to lubricate bit teeth 29. In practice, a mud motor system and drill combination known as a Mach I Mud Motor, manufactured by Eastman Christensen, is appropriate for practicing this process. It should, however, be understood that, within the scope of this disclosure, a number of directional drilling systems could be employed in a practice of the present process, and therefore no further discussion will be made herein concerning a comparison of different types and capabilities of directional drilling systems.

Shown in FIG. 6, immediately behind or upstream from the angle building motor system 27, is arranged the tool steering section 30. This tool steering section, it should be understood, is non-magnetic and may include both circuitry and an arrangement for controlling the motor system as required. Additionally, such steering tool may provide survey data, by radio or hard wire, to a surface installation, to supply the surface with steering control information. A survey tool for use in the tool steering section 30 identified as Directional Orientation Tool, manufactured by Eastman Christensen, has been found in practice to provide a desired magnetic flux for surface sensing drill bit location in three (3) planes. It should, however, be understood that other survey systems could be used within the scope of this disclosure.

In operation, the tool bit positioning is preferably checked continuously with changes in drilling direction sensed and ordered corrected for at the tool steering section 30. Further, in practice, the wellbore cuttings are checked periodically so as to determine or verify the material wherethrough the it 28 has passed. Thereby, an operator will timely know when the bit has contacted the coal seam. Additionally, by monitoring the pressure sensed in the production wellbore as compared to a measured pressure in the injection wellbore as it is being drilled, a certain differential pressure will be an indication of desired injector wellbore end proximity to that production wellbore. A pressure differential of approximately ten (10) psi, plus or minus two (2) psi, and taking into account the particular formation and its characteristics, will indicate that the injection wellbore is in proximity to the production wellbore.

As earlier set out herein, FIGS. 7 and 8 are included to show that the wellbores are preferably cased. In that casing, the respective production and injection wellbores are cemented with a conventional cement that is applied from the surface. Each such casing to extend from the surface to where the wellbore enters the burn module. In practice, such cement casing 32, as shown in FIGS. 7 and 8, of course, reduces the wellbore annulus by its thickness. The forming of such casing is formed by standard casing methods that are well known in the industry and therefore no further discussion will be made of the casing procedures or preferred materials used in such casing procedures.

With the production and injection wellbores 14, 18 and 19, respectively, formed and cased as described above, a burn material or enhancer can be introduced through the injection wellbores into the coal seam burn module 13 that is then ignited. The gaseous products of that burning to flow or are drawn to and through the production well to the surface for further processing.

Taking into account surface conditions it may be necessary to alter the drill platform 11 positioning from that shown in FIGS. 1 through 5. An alternative process is accordingly shown in FIG. 9 that shows the drilling as proceeding from a single surface location that is alongside, rather than above, a dipping coal seam 36 that includes a designated burn module 37. Such burn module 37, it should be understood, is like burn module 13 described hereinabove. In such drilling operation from the drill platform 34, a production wellbore 38 is shown curved or bent from a kick-off point 39 through a first angle towards the coal seam 36. That production wellbore is then redirected through a second angle at a second kick-off point 40 into the top of the burn module 37 to extend longitudinally therein, proximate to the seam bottom or floor. In this procedure, the drilling direction for the production wellbore is redirected twice through two separate angular attitudes at separated kick-off points 39 and 40 and is therefore more complicated to effect than is the production wellbore formed with the drilling scheme shown in FIG. 1 that involves only one angular change in drilling direction.

Figure 9:
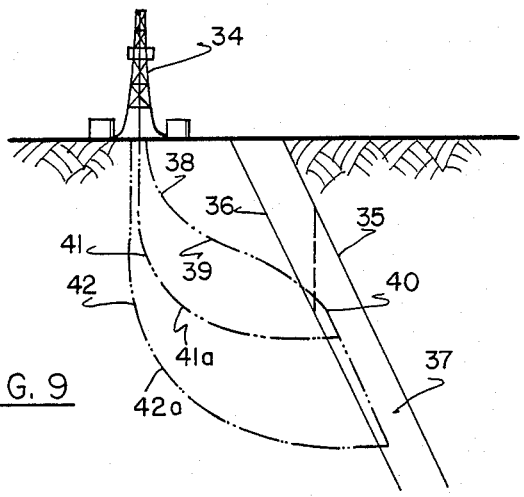
FIG. 9 shows another embodiment of the process for forming injection wellbores and a production wellbore from a single surface location into a burn module of a single dipping coal seam.

As shown in FIG. 9, injection wellbores 41 and 42 each involve only one drilling redirection from kick-off points 41*a* and 42*a*. respectively. The injection wellbore drilling direction changes are through approximately ninety (90) degrees. As shown, the injection wellbores 41 and 42 each, or each pair, enter the burn module 37 at a desired depth from the vertical so as to be adjacent to, but spaced apart from the production wellbore 38. The drilling of the injection wellbores 41 and 42 therefore requires a greater angular displacement than does the drilling of the injection wellbores 18 and 19 shown and described with respect to FIGS. 1 through 5.

The object of the drilling process of FIG. 9 is, of course, to form at minimum production and injection wellbores to designated points or locations in a designated burn module of a dipping coal seam like that described with respect to FIGS. 1 through 5. In this embodiment, as in the process of FIGS. 1 through 5, the drilling originates from a single surface location to a single dipping coal seam. Also, while, of course, the process shown in FIG. 9 involves a greater drilling distance to form the wellbores, like the process of FIGS. 1 through 5, it should be understood that the surface location that is selected as for the drilling platform 34 is as close to the coal seam as possible.

Figure 10:
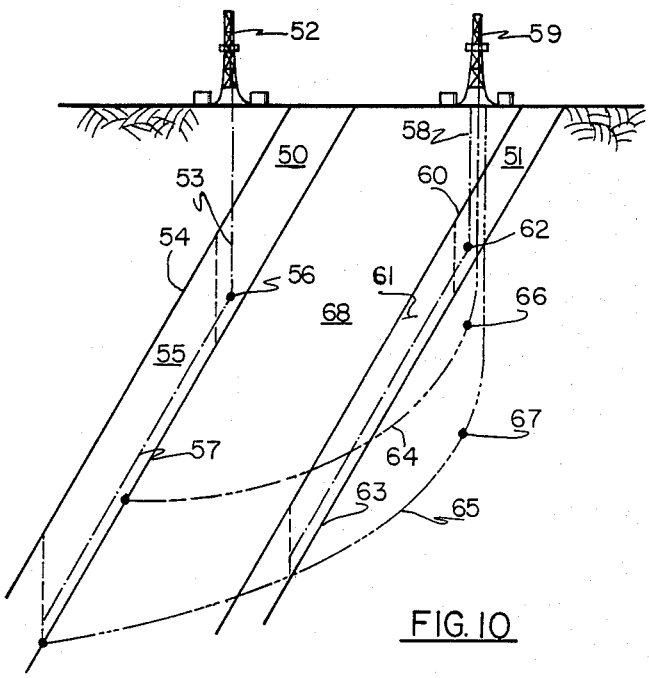
FIG. 10 shows a dipping coal formation with two coal seams showing production wellbores installed in each of the seams from separate surface locations, with injection wellbores formed to both seams from one of the surface locations.

Hereinabove has been described two variations of embodiments of coal gasification drilling processes of the present invention as practiced on a formation containing a single dipping coal seam. FIG. 10 shows a formation containing two separate processible dipping coal seams 50 and 51, respectively. For processing such multiple coal seam formation the present invention provides for drilling from a first drilling platform 52 a production wellbore 53. The production wellbore 53 is formed through the coal seam roof 54, above a designated burn module 55, and is then curved from a kick-off point 56 to a head or upper end of that burn module. As will the earlier embodiments, production wellbore 53 extends the length of the burn module 55 and is spaced apart from and above the burn module floor 57. The burn module 55 selection and the drilling of the production wellbore 53, it should be understood, is like that described with respect to the formation of the production wellbore 14, shown in FIGS. 1 through 5.

In this multiple coal seam embodiment forming a second production wellbore 58 in the coal seam 51 is accomplished from a second surface location, illustrated by drilling platform 59, that is positioned above the roof 60 of that coal seam 51. In turning wellbore 58 the drilling proceeds through roof 60, above a designated burn module 61, and is then curved from a kick-off point 62 into the head or top end of the burn module 61, and extends the length thereof, spaced above the floor 63 of that burn module. The production wellbores 53 and 58 of this embodiment are formed essentially alike but are formed from separate surface locations.

In the embodiment of FIG. 10, injection wellbores are formed from the same surface location wherefrom the production wellbore 58 is formed into coal seam 51, shown as drilling platform 59. As with the embodiment of FIGS. 1 through 5, injection wellbores 64 and 65 that may be single, multiple or pairs of wellbores, each pass, respectively, through the roof 60 and floor 63 of coal seam 51 burn module 61 and curve from kick-off points 67 and 68 back into coal seam 51, at spaced apart locations. Unique to this embodiment, each injection wellbore passes through that lower coal seam 61 burn module 63, through an intervening rock section 68 and through the floor 57 of coal seam 50 burn module 55. Both the injection wellbores 64 and 65, pass alongside and spaced apart a suitable distance from the production wellbore 58 to pass a gaseous flow therebetween, with injection wellbores 64 and 65 ends located adjacent to and spaced apart appropriately from the production wellbore 53 to pass a gaseous floor therebetween.

In practice, the casing of the production wellbores 53 and 58 is as described hereinabove with respect to FIGS. 1 through 5 and 7. The injection wellbores 64 and 65, however, are cased from the surface, through the coal seam 51 burn module 61 and through the intervening rock 68 and to the burn module 55 of coal seam 50. The burn module 55 of coal seam 50 is burned first by passing a burn material or enhancer through the cased wellbores and igniting same. The productions of that combustion to be pulled through production wellbore 53 to the surface. After the burn module 55 is fully burned, the injection wellbores 64 and 65 are plugged from that burn module to within the burn module 61 of coal seam 51 and the casings are perforated or slotted adjacent to the production wellbore 58. The burn module 61 is then ignited by passage of the burn material or enhancer through the perforated or broken injection wellbore casings, and the gaseous products of that combustion are withdrawn through production wellbore 58.

In the embodiment of FIG. 10, the process of the present invention is shown practiced on two dipping coal seams layered in the same formation. It should be understood, however, that this procedure is applicable to more than the shown two dipping coal seams within the scope of this disclosure. It should also be understood that the drilling procedures and equipment for forming the production and injection wellbores of FIG. 10 and the casing thereof, are like those shown and described with respect to FIGS. 1 through 9 above.

Summarizing, the first drilling process embodiment involves, from a single surface location, above a dipping coal seam, forming a production wellbore through the roof or ceiling of a coal seam above a designated burn module and drilling longitudinally therein the length of that module. With injection wellbores drilled through the roof or ceiling and floor or bottom of that coal seam that are then curved or turned back to the burn module. Like the above, the second preferred embodiment, illustrated in FIG. 9, shows production and injection wellbores also formed from a single surface location, that is alongside the coal seam floor with that coal seam angled away from that location. In this arrangement, the production wellbore is formed with two angular displacements towards and into the coal seam to travel longitudinally within a burn module of that coal seam. With the injection wellbores drilled through a single angular change of approximately ninety (90) degrees of direction to intersect the burn module at different vertical depths and at angles to that production wellbore.

The third embodiment for practice on a plurality of coal seams in a single forming utilizes a separate surface location for each production wellbore, with all the injection wellbores formed from one surface location.

The above has set out preferred practices or embodiments of drilling processes of the present invention for in-situ processing a dipping coal seam by forming production and injection wellbores from the surface location. It should, however, be understood that the present disclosure is made by way of example only and that the process and practice thereof may be varied without departing from the subject matter coming within the scope of the following claims, which claims I regard as my invention.

We claim:

1. A process for in-situ gasification of a section of a formation containing at least one below surface dipping coal seam comprising the steps of, dimensionally identifying a section of each coal seam of the formation that is an area of the coal seam between head and foot ends with opposite sides and a roof and floor as a burn module; for each coal seam positioning a drilling platform on a ground surface location that is axially offset over said coal seam roof from a vertical line extending upwardly from the head end of said burn module to the ground surface; directionally drilling a production wellbore vertically from each drilling platform through said coal seam roof to intersect the coal seam and curve into the designated burn module at the head end thereof, said production well bore extending longitudinally the length of said burn module; from one drilling platform that is used for drilling a production wellbore, directionally drilling at least one pair of injection wellbores through said coal seam roof and floor into that burn module at approximately a right angle to and spaced apart a distance from said production wellbore; during drilling of said production and injection wellbores, tracking the subsurface location of the drilling bit; introducing a burn material or enhancer through at least one of the injection wellbores that is then ignited to burn the coal seam burn module; and withdrawing the products of that combustion through the production wellbore for further processing.

2. A process as recited in claim 1, wherein the dipping coal seam that is selected for processing is at an angle of from twenty (20) degrees to eighty (80) degrees from the horizontal.

3. A process as recited in claim 1, wherein for a formation containing a single dipping coal seam, from a single surface location, drilling the injection wellbores from the drilling platform on the ground surface in pairs, each pair drilled through the coal seam roof and floor and curved back to the burn module to a desired true vertical depth (TVD) in the burn module on opposite sides of the production wellbore, and the injection wellbore head ends are essentially aligned with one another; and the production wellbore ground surface is off-set a distance towards or away from the vertical line from the head end of the burn module, at a right angle to the line of aligned injection wellbore ground surface ends.

4. A process as recited in claim 3, wherein the injection wellbores are drilled in multiple pairs, one pair intersecting approximately the burn module enter with a second pair intersecting approximately the foot end of said burn module, each individual wellbore of each pair intersecting opposite sides of said burn module.

5. A process as recited in claim 1, further including the step of, during drilling, estimating the subsurface position of the drilling bit by analyzing the rock cuttings passed up the wellbore.

6. A process as recited in claim 1, further including the step of, during drilling, estimating the subsurface positioning of the drilling bit by sensing at the surface a signal from a tool steering section connected in tandem to a motor turning the drilling bit, which sensed signal is interpreted to locate the drilling bit triaxially.

7. A process as recited in claim 1, further including the step of casing the production and injection wellbores from the surface to where they enter the burn module of the coal seam to be burned.

8. A process as recited in claim 1, wherein for a formation containing multiple dipping coal seams in each said coal seam dimensionally identifying a burn module and drilling each production wellbore to each said burn module from a separate surface location; and at least one pair of injection wellbores is drilled from one of said surface locations.

9. A process as recited in claim 8, wherein each production wellbore is approximately laterally centered in the burn module and is spaced approximately five (5) feet above said burn module floor along its entire length.

10. A process as recited in claim 8, wherein the production and injection wellbores are drilled through the coal seam roofs, the injection wellbores passing through the lowest coal seam in the formation to curve back into said formation, passing through the formation into the floor of the highest coal seam in said formation.

11. A process as recited in claim 10, further including casing the individual production wellbores from the surface to the head end of the burn module wherein it is formed; and casing the injection wellbores from the surface through and back into the formation to their entry into the uppermost coal seam burn module.

12. A process as recited in claim 11, further including, after processing by burning the uppermost coal seam burn module of the multiple dipping coal seams plugging the cased injection wellbores to within a next lowest coal seam burn module; and perforating or slotting the injection wellbore casing adjacent to the production wellbore in said next lowest from the surface coal seam burn module.

* * * * *